United States Patent [19]

Yamamoto et al.

[11] Patent Number: 4,834,213

[45] Date of Patent: May 30, 1989

[54] NOISE SILENCER FOR USE IN JOINT GAP IN HIGHWAY

[76] Inventors: Ikuro Yamamoto, 8-15, Tamatsukuri 1-chome, Higashi-ku, Osaka; Keiji Koga, 9-25, Nakanoshinmachi, Shijyonawate-shi, Osaka, both of Japan

[21] Appl. No.: 247,266

[22] Filed: Sep. 21, 1988

[51] Int. Cl.[4] ..... E04B 1/82

[52] U.S. Cl. ..... 181/210; 181/284; 181/288; 181/290; 181/294

[58] Field of Search ..... 181/210, 284, 288, 290, 181/294, DIG. 1, 291

[56] References Cited

U.S. PATENT DOCUMENTS 2,401,906 6/1946 Burnett et al. ..... 181/284 X 3,983,956 10/1976 Manhurt ..... 181/210

4,274,506 6/1981 Blomgoon et al. ..... 181/210

4,330,046 5/1982 Lerner et al. ..... 181/210

*Primary Examiner*—B. R. Fuller

*Attorney, Agent, or Firm*—Wenderoth, Lind & Ponack

[57] ABSTRACT

A noise silencer for highway is adapted to be stuffed in a joint gap formed in a highway. It has a rectangular casing and padding enclosed in the casing. The casing is provided with a vent hole adapted to be closed by a plug. Before mounting the noise silencer, air is firstly sucked out from the silencer through the vent hole to flatten the padding and the vent hole is plugged. After the silencer has been mounted, the vent hole is open to inflate the padding so that the silencer will be pressed against the opposite walls of the joint gap.

3 Claims, 1 Drawing Sheet

NOISE SILENCER FOR USE IN JOINT GAP IN HIGHWAY

BACKGROUND OF THE INVENTION

The present invention relates to a noise silencer adapted to be stuffed in a joint gap formed in an elevated highway in a transverse direction so as to prevent the noise on the highway from leaking downwardly through the joint to the underside thereof.

It is customary to provide noise absorbing walls at both sides of elevated and unelevated highways in order to keep neighboring residents free from the noise. But only the provision of such side walls cannot provide a satisfactory noise prevention measure especially if the highway is of an elevated type, because the noise can also leak out through transverse joint gaps formed through the bed of the road at given intervals so as to offset expansion and shrinkage of the roadway resulting from temperature fluctuation. Thus, the noise produced by the automobiles running on the highway, especially the impact noise produced when they run over metal joints provided to bridge the joint gaps, may leak downwardly through the gaps, reaching people living near the highway. This will invite complaints from them.

No effective measures have been developed to keep the noise from leaking through the joint gaps formed in the highway bed without impairing their inherent function.

SUMMARY OF THE INVENTION

It is an object of the present invention to provide a noise silencer which is adapted to be stuffed in a joint gap formed through the bed of a highway and which obviates the abovesaid shortcomings.

In accordance with the present invention, there is provided a noise silencer for use in a joint gap in a highway, comprising a casing made of a non-air-permeable, soft high polymeric material; and a rectangular padding made of a permeable foamed material and enclosed in the casing in an airtight manner; the casing being provided with a vent hole adapted to be closed by a plug; the padding having a width larger than the width of the joint gap when not in a compressed state.

In mounting the noise silencer in the joint gap formed in the bed of a highway, the plugs are pulled out to open the vent holes and hoses of a suction device are inserted into the vent holes to draw the air in the casing and thus in the padding to flatten the entire silencer. The hoses are then pulled out and the vent holes are plugged. The noise silencer thus flattened is inserted fully into the joint gap from below. Then the vent holes are unplugged again to allow the padding or urethane foam to suck in air and inflate into its original state. The noise silencer thus undetachably and tightly pressed against the walls of the joint gap will serve to absorb the noise which comes into the joint gap.

The noise silencer according to the present invention is shrinkable into an extremely flat shape by drawing the air in the padding through the vent holes by means of a suction device. Thus, it can be easily inserted into the joint gap.

Further, since the noise silencer has a larger width than the width of the joint gap, it can tightly and undetachably press against the opposite walls of the joint gap without the fear of falling once it inflates back into its original state.

Other features and objects of the present invention will become apparent from the following description taken with reference to the accompanying drawings, in which:

DETAILED DESCRIPTION OF THE PREFERRED EMBODIMENT

Figure 1:
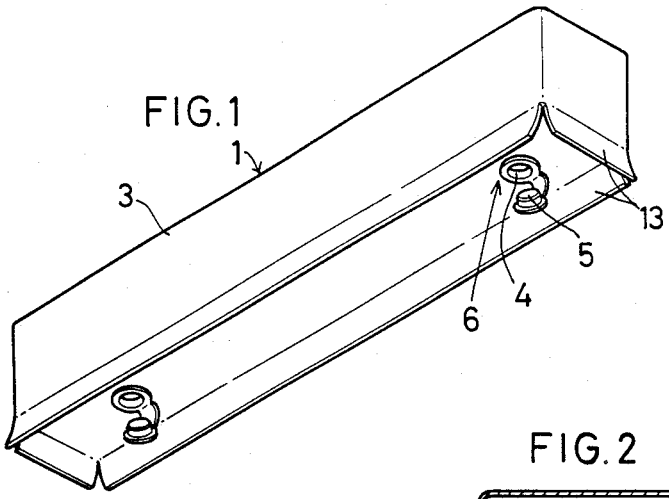
FIG. 1 is a perspective view of the first embodiment of the noise silencer according to the present invention.
Figure 2:
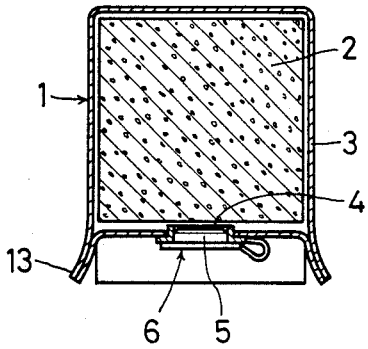
FIG. 2 is an enlarged sectional view of the same.

FIG. 1 shows an embodiment of the noise silencer 1 adapted to be stuffed in a joint gap formed through the bed of an elevated highway so as to extend transversely. As shown in FIG. 2, it comprises a rectangular padding 2 made of air-permeable foamed material such as urethane foam and a non-air-permeable rectangular bag or casing 3 made of a soft high polymeric material and enclosing the padding 2 to keep it airtight. The casing 3 is formed in one side face with vent holes 4 adapted to be closed by lids 5 of plugs 6.

When not compressed, the padding 2 should have a larger width than, preferably nearly twice as wide as the width of a transverse joint gap 8 formed through a highway bed 7.

Figure 3:
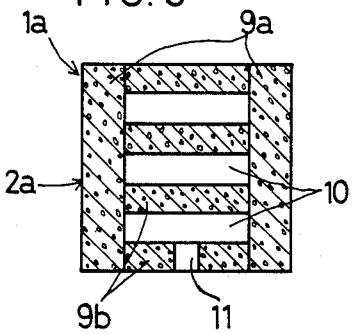
FIG. 3 is a sectional view of the padding of the noise silencer of the second embodiment.

A shock silencer 1*a* in the second embodiment is shown in FIG. 3 which has a rectangular padding 2*a* comprising a pair of urethane foam side plates 9*a* and four urethane foam plates 9*b* interposed between the side plates 9*a* so as to extend parallel to one another and at a right angle to the plates 9*a*. Between the adjacent plates 9*b* are formed spaces 10 which are substantially as thick as each plate 9*b*. One of the plates 9*b* located outermost is formed with vent holes 11. The padding 2*a* is enclosed in a rectangular (not shown) provided with plugs adapted to fit into the holes 11.

In mounting the noise silencer 1 or 1*a* in the gap 8 formed in an elevated highway 7, the plugs 6 are pulled out and suction nozzles of a suction device (not shown) are inserted into the vent holes 4. Then, the air in the noise silencer is drawn to shrink it, while adjusting its position in such a manner that its four sides will face the respective inner walls of the casing 3. The noise silencer 1*a* shown in FIG. 3 would shrink by itself by applying a suction force in such a direction that the plates 9*b* are compressed.

When the noise silencer 1 or 1*a* has shrunk sufficiently, its vent holes 4 are closed with the plugs 6. Then it is fitted into the joint gap formed in the highway bed with its side having the plugs 6 downward. The plug 6 is again pulled out to open the vent hole 4. The padding 2 or 2*a* made of urethane foam now begins to inflate while drawing the ambient air by the action of its restoring force so as to press the side walls of the casing 3 against opposite side walls 12*a* and 12*b* of the joint gap 8. The noise silencer thus undetachably held in the joint gap 8 will serve to stop the noise on the road surface from leakage downwardly through the joint gap 8.

Figure 4:
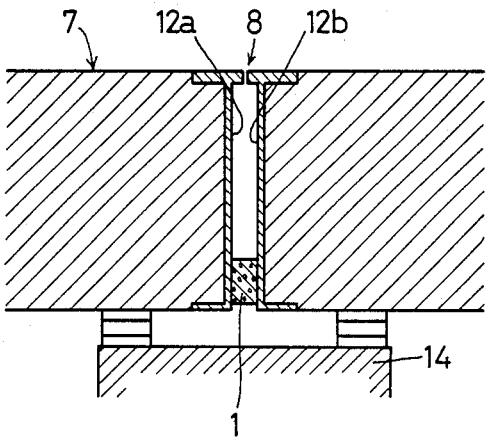
FIG. 4 is a vertical sectional side view showing how the noise silencer is mounted in the highway bed.

As shown in FIG. 2, the casing 3 should be provided with aprons 13 along the edge of the surface having the vent holes 4 so as to prevent rain drops from flowing into the body through the holes 4. In FIG. 4, numeral 14 designates a bridge pier.

What is claimed is:

1. A noise silencer for use in a joint gap in a highway, comprising:

a casing made of non-air-permeable, soft high polymeric material; and a rectangular padding made of a permeable foamed material and enclosed in said casing in an airtight manner;

said casing being provided with a vent hole adapted to be closed by a plug;

said padding having a width larger than a width of said joint gap when not in a compressed state.

2. A noise silencer as claimed in claim 1, wherein said padding comprises an integral member.

3. A noise silencer as claimed in claim 1, wherein said padding comprises a pair of side plates and a plurality of horizontal plates disposed between said side plates with spacings therebetween so as to be parallel to one another and at a right angle to said side plates.

* * * * *